United States Patent [19]

Meier et al.

[11] Patent Number: 4,929,424

[45] Date of Patent: May 29, 1990

[54] PREVENTION OF VAPOR PHASE CORROSION CAUSED BY HALOGENS IN BREWERY PASTEURIZERS

[75] Inventors: Daniel A. Meier, Naperville; Michael J. Groshans, Lombard, both of Ill.

[73] Assignee: Nalco Chemical Company, Naperville, Ill.

[21] Appl. No.: 180,219

[22] Filed: Apr. 11, 1988

[51] Int. Cl.[5] ..... C23F 11/02; C23F 11/06

[52] U.S. Cl. ..... 422/9; 210/698; 210/699; 210/749; 210/753; 210/754; 210/756; 210/764; 252/391; 252/397; 422/7; 422/37

[58] Field of Search ..... 210/749, 753, 754, 755, 210/756, 699, 698, 764; 422/9, 37, 7; 252/388, 391, 397

[56] References Cited

U.S. PATENT DOCUMENTS

| | | | |
|---|---|---|---|
| 3,558,503 | 1/1971 | Goodenough | 252/187 |
| 4,642,194 | 2/1987 | Johnson | 210/699 |
| 4,643,835 | 2/1987 | Koeplin-Gall | 210/754 |
| 4,759,852 | 7/1988 | Trulear | 210/699 |

OTHER PUBLICATIONS

Derwent Abstract-62497E, (Abstracting Japanese Patent-57098680).

*Primary Examiner*—Christine M. Nucker
*Assistant Examiner*—Timothy M. McMahon
*Attorney, Agent, or Firm*—John G. Premo; John S. Roberts, Jr.; Anthony L. Cupoli

[57] ABSTRACT

A method of inhibiting the corrosion of the metal surfaces of beer pasteurizing units in contact with halogenated water vapor which comprise treating these halogenated waters with at least ¼ ppm sulfamic acid for each ppm of halogen present in these waters.

5 Claims, 3 Drawing Sheets

PREVENTION OF VAPOR PHASE CORROSION CAUSED BY HALOGENS IN BREWERY PASTEURIZERS

INTRODUCTION

Beer is frequently pasteurized after it is bottled or canned by passing these containers through a moving belt horizontal pasteurizer. As the containers move through the pasteurizer, they are subjected to sprays of hot water which contains chlorine or another halogen biocide which is recirculated from sumps within the unit. The temperature of the chlorinated hot water and its vapors varies between 60°–160°F. The entrance and exit of these pasteurizers use lower temperature waters, whereas the higher temperature waters are found in the central zone of these units.

These waters are chlorinated to prevent bacterial growth. The bacterial growth occurs because of the beer contamination of the water and the temperature of the water. The amount of chlorine necessary to control biological growth in these waters usually varies between 0–10 ppm as $Cl_2$ residual. Because of this environment, severe corrosion occurs on exposed metal parts which contact the vapors within and near these pasteurizing units. The primary source of this corrosion is the chlorine or other halogen in the vapors.

The method now used to prevent corrosion in these units is to use as materials of construction corrosion resistant alloys and plastics. Another approach has been to place corrosion resistant coatings on exposed metal surfaces in and near these units. Neither of these approaches has substantially eliminated, or to any great extent abated, the corrosion problems described above.

As indicated, the beer pasteurizing units described are open at each end. Workers in the area surrounding these pasteurizers are exposed to the water vapor generated during the pasteurizing process. While it would be possible to consider using known volatile corrosion inhibitors, the use of many of these inhibitors is excluded due to toxicity considerations with respect to the workers present in the areas near these pasteurizers.

This invention provides a solution to the corrosion problems described by treating the halogen-containing water with sulfamic acid.

THE DRAWINGS

Figure 1:
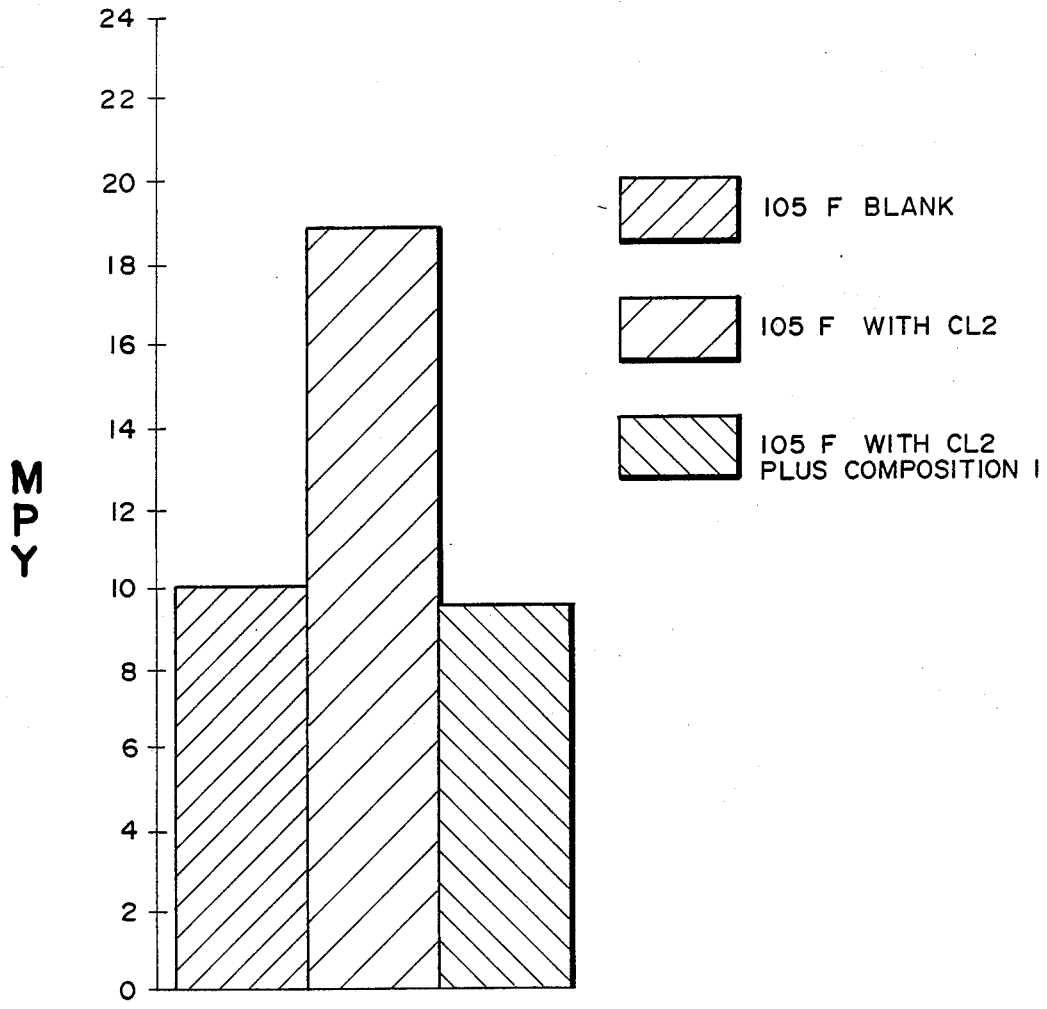
Figure 2:
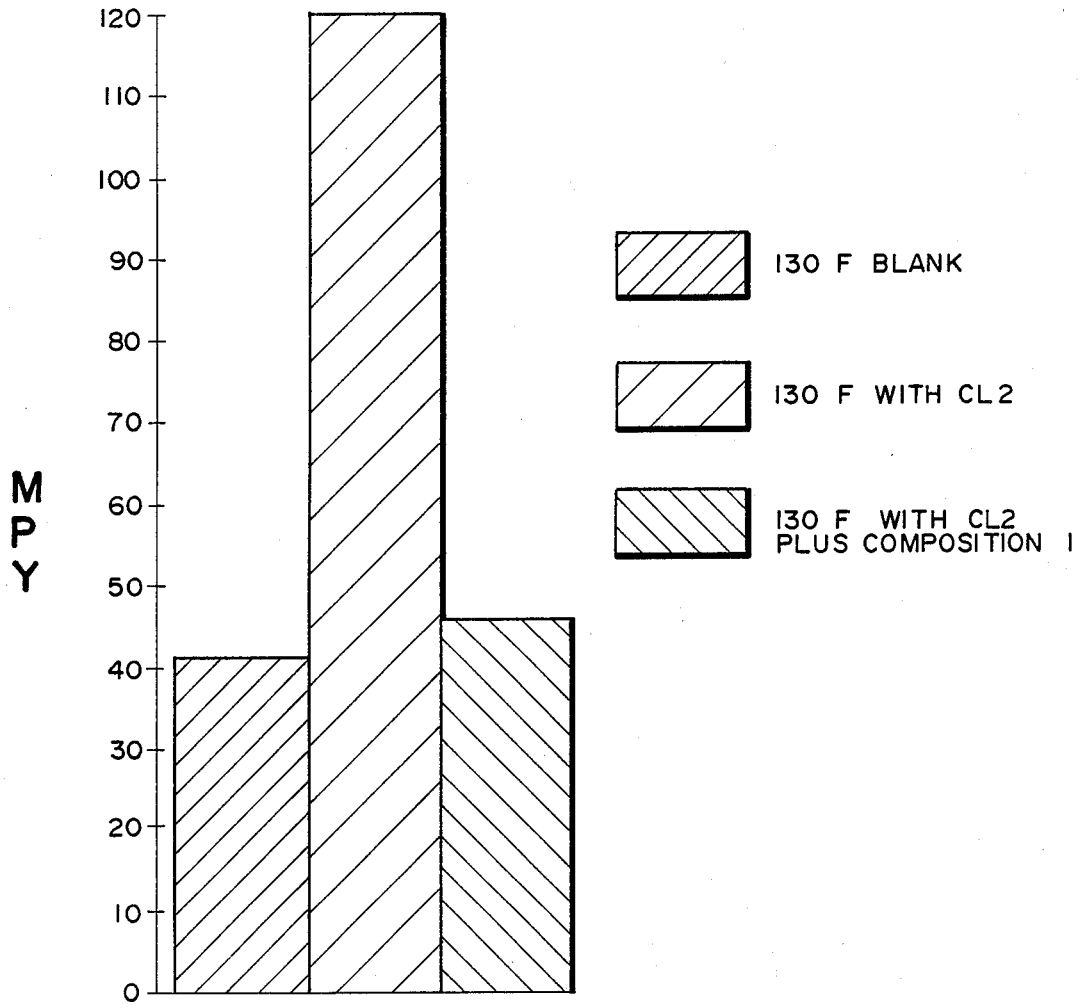
Figure 3:
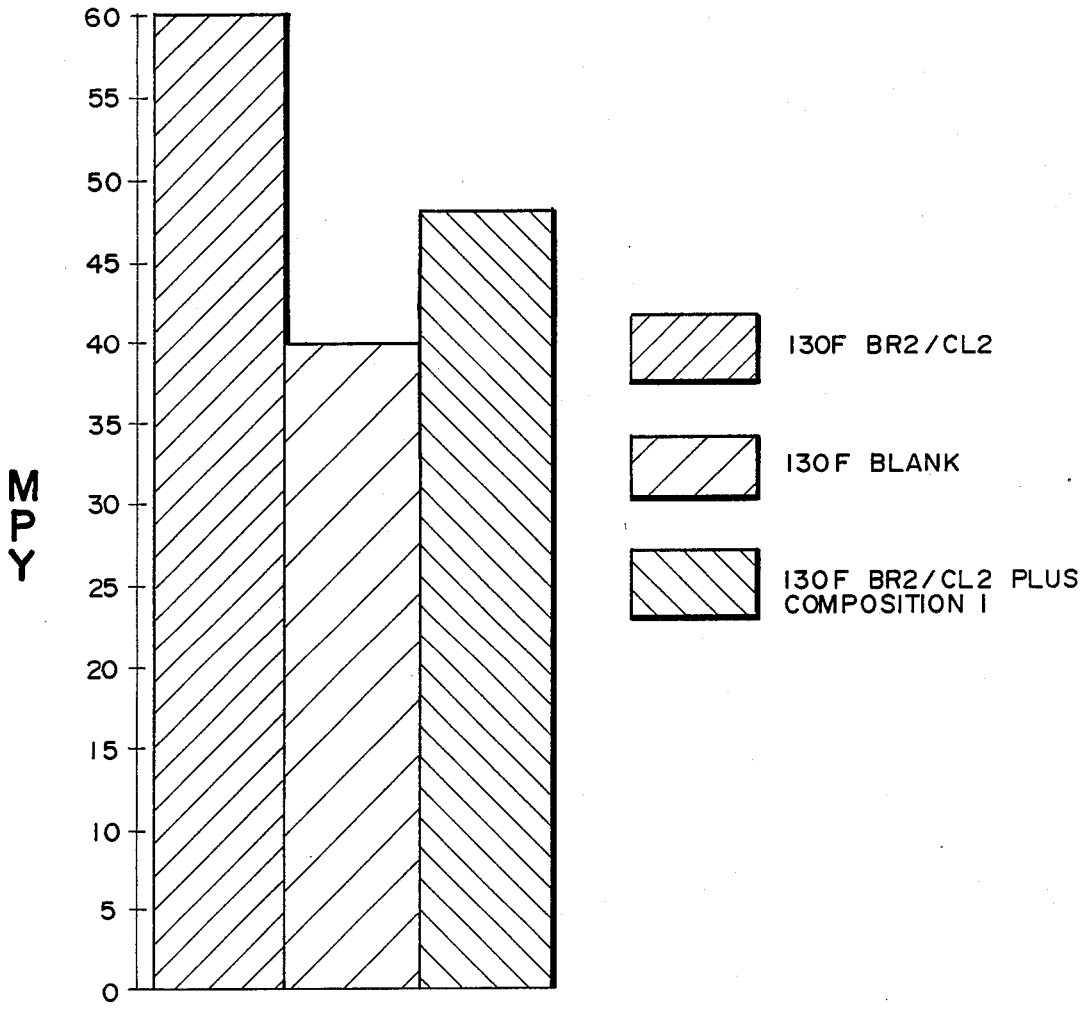

FIGS. 1–3 show the effectiveness of sulfamic acid to prevent halogen vapor phase corrosion in beer container pasteurizers.

THE INVENTION

The invention specifically provides a method of inhibiting the corrosion of the metal surfaces of beer pasteurizing units in contact with halogenated water vapors which comprise treating these halogenated waters with at least ¼ ppm sulfamic acid for each ppm of halogen present in these waters. In a preferred embodiment of the invention, the sulfamic acid is used at a dosage of from ½ to about 4 ppm for each ppm of halogen present in these waters.

It is convenient to add the sulfamic acid to the make-up water or to the water actually being recirculated within the pasteurizer.

The Halogens

The halogens used as the sterilizing bacterial biocidal agents in beer pasteurizers will in most instances be chlorine. The pasteurizers also use or may use as the microbiological agents halogen mixtures such as chlorine and bromine which are hereafter described as chlorine-bromine biocides. In addition to the elemental-type biocides, the so-called halogen release biocides also may be used, e.g.:

A. The Halogen Release Biocides

Sodium hypochlorite, calcium hypochlorite, sodium dichloro-s-triazine trione dihydrate, 1-bromo-3-chloro-5,5dimethylhydantoin, and chlorinated isocyanurates.

B. The Chlorine-Bromine Biocides

These are compositions comprising a chlorine solution and a bromide salt capable of releasing bromide ions to the chlorine solution.

Suitable bromide salts include the alkali and alkaline earth metal bromides but are not limited thereto. For instance, magnesium bromide, calcium bromide, sodium bromide, potassium bromide, ammonium bromide, and the like salts can be used, either singly or as mixture of two or more as desired.

A bromide salt, for example, sodium bromide, when introduced into a chlorine solution in which the chlorine is presently mostly as hypochlorous acid, has been shown to at least partially displace chlorine, resulting in the formation of the active biocide, hypobromous acid, and innoxious sodium chloride by-product as follows:

$$NaBr + HOCl \rightarrow NaCl + HOBr$$

In present chlorination installations, the bromide salt can merely be introduced downstream of the chlorine educting water line, at which point gaseous chlorine has already been introduced into a water stream and hydrolized to form the hypochlorous acid and hydrochloric acid, which usually would be an acidic chlorine solution. It can also be introduced into sodium hypochlorite solutions and will undergo the same reactions.

The bromide salts are themselves generally innoxious salts and thus their use in combination with chlorine presents no new or unknown hazards and makes use of the same chlorine introduction facilities that are now in use.

EXAMPLES

A small rectangular sump of 50 liter capacity was fitted with a circulation pump and appropriate piping. A header fitted with sprays was placed about 30 centimeters above the sump. The sprays created a misty vapor corresponding to that found in a beer pasteurizer. The vapor space was fitted with a Corrosometer[1], an electric corrosion measuring device which is described in the publication, Rohrback Instruments Bulletin #868B. Also contained in the vapor space were mild steel metal specimens. Each test ran for 7–14 days. The sulfamic acid was in the form of a formulated product having the following composition:

[1] Corrosometer is a registered trademark of Rohrback Instruments

| Composition I | |
|---|---|
| Water | 57.5% |
| Caustic soda 50% diaphragm cell | 18.5% |
| Sulfamic acid | 20.0% |
| Ethylene oxide-propylene oxide block copolymer | 2.0% |
| 2-cyclo-hexane,l-octanoic | 2.0% |

-continued

| Composition I |
| --- |
| acid, 5 or 6-carboxy-4-hexyl |

Two different tests were run at temperatures of 105° and 130° F. using a chlorinated water. These results are shown in FIGS. 1–2. FIG. 3 shows the advantages of sulfamic acid to prevent bromine chlorine corrosion.

Having thus described our invention, we claim:

1. A method of inhibiting the halogens vapor phase corrosion of the metal surfaces of beer pasteurizing units which utilize halogenated water which produces a halogen vapor phase which comprise treating these halogenated waters with from $\frac{1}{4}$ to 4 ppm of sulfamic acid for each ppm of halogen present in these waters and an alkalinizing amount of a soluble alkali.

2. The method of claim 1 where the halogen is $Cl_2$.

3. The method of claim 1 where the dosage of the sulfamic acid is at least $\frac{1}{2}$ ppm for each ppm of halogen.

4. The method of claim 3 where the halogen is $Cl_2$.

5. The method of claim 1 where the halogen is a bromine-chlorine biocide.

* * * * *